US006799699B1

(12) United States Patent
LeMarr et al.

(10) Patent No.: US 6,799,699 B1
(45) Date of Patent: Oct. 5, 2004

(54) DUAL CHAMBER, HEAT SEALABLE VIAL

(76) Inventors: Stephen Todd LeMarr, 1001 Drinnon Dr., Morristown, TN (US) 37814; Gerald Stephen LeMarr, 2462 Rosemead Dr., Morristown, TN (US) 37814; Kristopher Michael Oakes, 848 Shinbone Rd., Russellville, TN (US) 37860

( * ) Notice: Subject to any disclaimer, the term of this patent is extended or adjusted under 35 U.S.C. 154(b) by 0 days.

(21) Appl. No.: 10/446,951

(22) Filed: May 28, 2003

(51) Int. Cl.[7] ..... B65D 35/22
(52) U.S. Cl. ..... 222/94; 222/129; 222/541.9
(58) Field of Search ..... 222/94, 129, 541.9

(56) References Cited

U.S. PATENT DOCUMENTS 5,725,499 A * 3/1998 Silverstein et al. ..... 604/82
6,247,617 B1 * 6/2001 Clyde et al. ..... 222/94
D456,507 S * 4/2002 LeMarr et al. ..... D24/115

* cited by examiner

*Primary Examiner*—Philippe Derakshani
(74) *Attorney, Agent, or Firm*—Stephen J. Stark; Miller & Martin PLLC

(57) ABSTRACT

A dual chamber vial as formed having a body separated into two chambers by a baffle located in a cavity of the vial body. The baffle is oriented at an angle at about 30° and 60° relative to an axis extending perpendicularly through opposing parallel walls of the vial body. The baffle terminates intermediate the first and second ends of the body where slopes direct the fluid from the chambers to outlets. The outlets are initially closed with a key having a center post which extends along the center axis of the vial body providing an axis of rotation to allow twisting of the key relative to the body to place the vial outlets in an open configuration.

19 Claims, 1 Drawing Sheet

DUAL CHAMBER, HEAT SEALABLE VIAL

BACKGROUND OF THE INVENTION

1. Field of the Invention

The present invention relates to a vial having internally divided chambers that dispense through separate outlets, and more particularly to a heat sealable nebulizer vial design that allows for separated storage of multiple solutions while providing a single opener to access outlets of the multiple chambers for dispensing the solutions from the vial.

2. Description of Related Art

Multiple chambered vials have been utilized to dispense separately housed solutions. U.S. Pat. No. 6,247,617 shows one such design with a rather intriguing neck design. This design dispenses two liquids angularly toward one another. In this design, the separated chambers cannot be mixed together internal to the vial structure since the outlets are spaced apart from one another on external portions of the vial. A single operator, or key is utilized to expose the two outlets for dispensing the solutions.

Other multiple chambered vial designs are shown and described in U.S. Pat. Nos. 3,224,640, 3,227,319, 4,687,663, and 5,897,833. These designs also have separate chambers for storing solutions therein. Some dispense from a single outlet, others dispense from multiple outlets of various configurations. Syringes have also been devised to dispense two solutions via a single container as shown in U.S. Pat. Nos. 3,166,221 and 5,752,499.

None of the prior art vials are configured to be pharmacist filled, i.e., they are not provided with an opening for filling the chambers of the vials with liquid, and then resealing similar to those shown in U.S. Design Pat. No. D456,507 owned by the applicant.

Accordingly, a need exists for an improved vial design.

SUMMARY OF THE INVENTION

It is an object of the invention to provide a multiple chambered vial having a reliable key structure to expose multiple openings for dispensing solutions from the chambers.

It is another object of the present invention to provide a vial having internally separated chambers having an internal twisting structure to direct solution through the outlets.

Another object of the present invention is to provide a heat sealable vial with internally divided chambers.

Accordingly, a vial of the presently preferred embodiment is comprised of housing having a cavity therein internally divided into a plurality of, preferably two, chambers. The chambers are separated by a baffle which prevents communication of the solutions in the vial. A first end of the housing is preferably provided open for filling the vials by a pharmacist. The second end of the housing has spaced apart outlets which correspond in number to the number of internal chambers. The outlets are preferably coplanar with one another and preferably positioned to be perpendicular to an axis extending a length of the housing. The internal chambers, while symmetric about an axis extending along the length of the housing through the center of housing, are preferably somewhat overlapping which is believed to assist in the dispensing of fluid. Specifically, a cross section of the housing is preferably characterized by opposed parallel walls connected by symmetric curved portions. Although the shape is truly not elliptical, elliptical is utilized throughout this document to include this geometry. The baffle is preferably a planar structure which extends through the center of the axes of the cross section of the ellipse, but is not coplanar with either of the two axes of the ellipse. Since a user will normally depress the sides of the housing along the shorter of the ellipse axes (i.e., the parallel walls), the offset angular relationship of the baffle during the squeezing of the tube is believed to assist in the dispensing of the liquid from the chambers.

On exterior portions of the housing are outlets initially closed by a single key member. By removing the key, the outlets are opened for dispensing solution therefrom. Caps which secure each of the respective outlets form a portion of the key. Additionally, wings extend from the housing to connect multiple vials together to assist a pharmacist in filling multiple vials in a single filling operation.

BRIEF DESCRIPTION OF THE DRAWINGS

The particular features and advantages of the invention as well as other objects will become apparent from the following description taken in connection with the accompanying drawings in which.

DETAILED DESCRIPTION OF THE DRAWINGS

Figure 1:
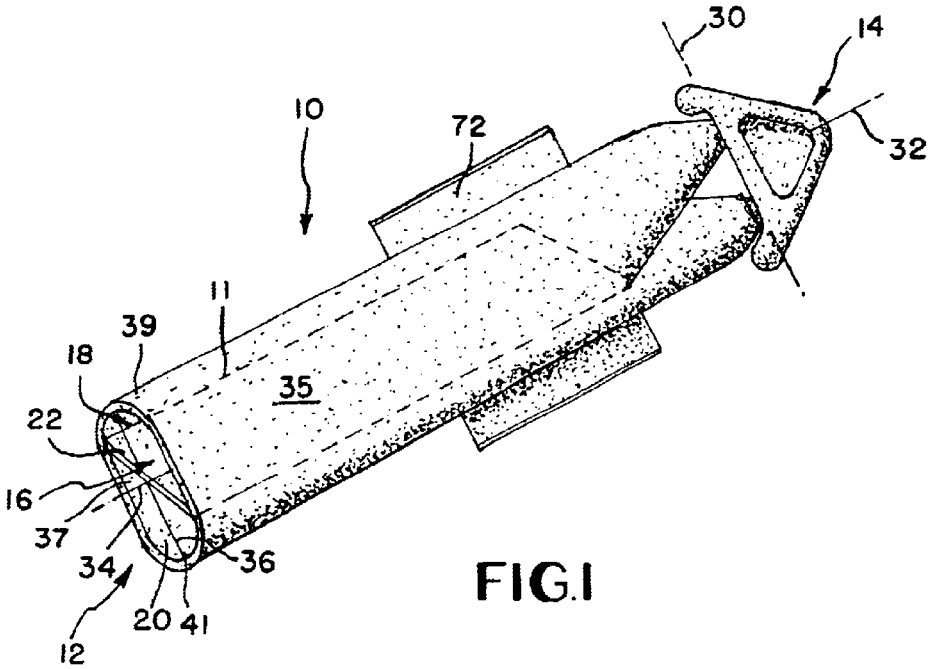
FIG. 1 is a side elevational view of a single vial of the preferred embodiment of the present invention.

FIG. 1 shows a vial 10 of the preferred embodiment of the present invention. The vial 10 has a housing, or body 11, beginning at a first end 12, and terminating at an opposing second end 14. The housing has a cavity 16 therein, preferably subdivided into two chambers 18,20 with a baffle 22.

As the vial 10 proceeds from the first end 12 toward the second end 14, outlets 24,26 which correspond in number to the chambers 18,20 contained within the body 11 are located on the housing 11. The outlets 24,26 are initially closed with a key 28 which is attached to the body 11 of the vial 10 preferably at the second end 14 of the vial 10. The outlets 24,26 are preferably coplanar along outlet plane 30 which is perpendicular to vial axis 32. Vial axis 32 extends along a centerline of the vial 10. If the vial 10 is substantially elliptical as illustrated then the vial axis 32 extends through the intersection of the ellipse or first and second axes 34,36 of a cross section portion of the body 10 toward the first end 12. First and second axes 34,36 are also referred to as first and second axis segments which includes non-elliptical cross sections as described herein. Other cross section configurations may also be utilized and the first and second axes 34,36 will be meant to refer to perpendicular axes each bisecting the cavity 16 in the vial 10 with the first axis 34 passing perpendicularly through parallel walls 35,37. Second axis passes through curved edge segments 39,41 which connect to the parallel walls 35,37 to form the cross section.

Figure 2:
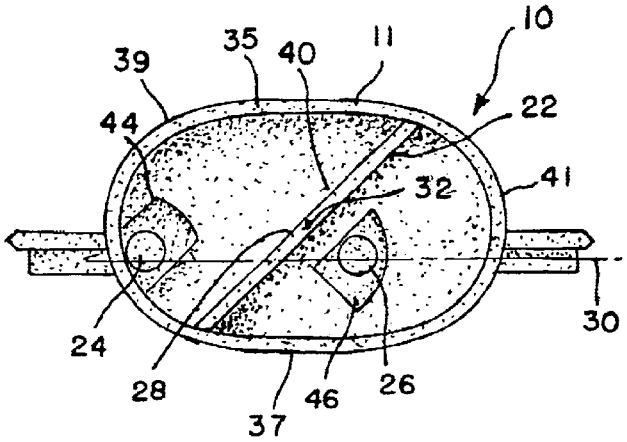
FIG. 2 is a bottom perspective view of the internal portions of the vial of FIG. 1.

FIG. 2 shows the preferred shape of the housing 11 at the first end 12. The baffle 22 is illustrated angled relative to the center axis 32 at intermediate about a thirty to sixty degree angle relative to either of the first and second axes 34,36 shown in FIG. 1. As the baffle 22 proceeds from the first end toward the second end 14, it preferably contacts valley 38 which is illustrated spaced from the outlet plane 30 as well as the second end 14. The valley 38 begins along the baffle 22 and preferably angles upwardly along opposing slopes 40,42 which are illustrated as symmetric to one another about a plane extending through the baffle 22. Both slopes 40,42 intersect a plane formed by the intersection of the center axis 32 with the first ellipse axis 34, which is illustrated as the shorter of the two axes 34,36.

As can be seen in FIG. 2, solutions would be expelled from outlets 24,26, as the solution proceeds through the respective chamber 18 or 20 flowing at least somewhat parallel to the center axis 32. At the valley 38, a portion of the solution contact the respective slope 40 or 42 which imparts lateral movement to at least a portion of the solution to direct it to the outlet 24 or 26. Once the solution proceeds proximate to the outlets 24,26, nozzles 44,46 may further assist in directing flow out of the outlets 24,26.

The vials 10 are preferably provided to pharmacists empty as shown in the Figures with multiple vials connected together by wings 72. When the pharmacist receives the vials 10, they are filled with the appropriate solutions in each of the chambers 18,20 and the first end 12 is heat sealed to contain the solutions in the respective chambers 18,20. Heat sealing may be performed with various prior art implements.

When dispensing liquid from a filled (and sealed) vial 10, it is believed that the user will open the outlets 24,26 as will be discussed in further detail below. Next the user will apply pressure to the housing 11, probably along the first axis 34 by squeezing the parallel walls 35,37 together. This will initial result in more compression in narrow corner volumes 48,50 than in broader corner volumes 52,54. As more and more pressure is applied along the first ellipse axis 34, the baffle 22 is believed to assist in forcing solution from the respective chambers 18 or 20 as it contacts the interior surfaces 56,58 of the housing 11.

In prior art multi-chambered vials, there are many designs where a baffle structure would be coplanar along the first ellipse axis so that it would play no part in assisting dispensing fluid when compressing the vial between opposing parallel walls. There are also numerous designs where the baffle is perpendicular to opposing parallel walls. However in these designs, the solutions are dispensed parallel to the central axis without a slope coming into play. Furthermore, in these designs, the outlets are bisected by the first axes, as opposed to being spaced apart and symmetrical as is performed by the construction of the presently preferred embodiment.

Figure 3:
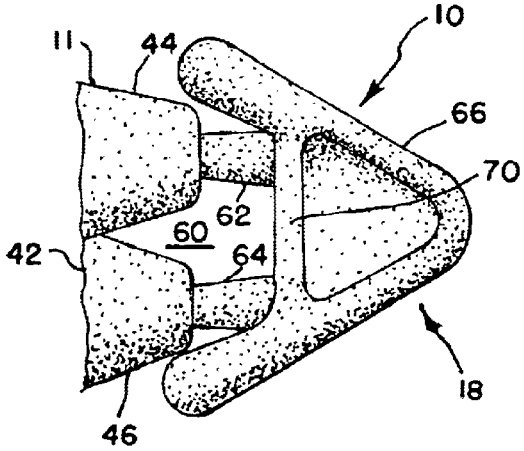
FIG. 3 is a close up side view of a top portion of the vial illustrated in FIG. 1.

In the close up view shown in FIG. 3, the nozzles 44,46 are illustrated as spaced apart from one another and symmetric about both a plane extending along the center axis 32 extending through the baffle 22 as well as through the first axis 34. It should be obvious to one skilled in the art that although "ellipse axis" is utilized in this specification, other shapes could exist whether they be rectangles, other curved shapes, or other "sided" shapes and still have perpendicular axes which extend perpendicularly relative to one another and intersect along the center axis of the vial 10. As provided relative to the preferred embodiment, the second axis 36, or second ellipse axes, would be included in a plane extending through the outlets and the center axis 32 of the vial 10. The first axis 34 would extend perpendicularly to the second axis 36.

As shown in FIG. 3, the slopes 40 (obscured from view) and 42 are spaced by depression 60 which separates the nozzles 44,46 from one another. FIG. 3 also shows the key 28 configuration. The key 28 has caps 62,64 which correspond in number to the number of outlets 24,26, and thus the number of chamber 18,20. The caps are preferably integrally formed into key handle 66. Key handle 66 provides a gripping location for a user to be able to remove the key 66 from the body 11 to expose the outlets 24,26 for dispensing solution therefrom.

The key 28 also includes a beam 70 connecting the caps 62,64 together relative to the key handle 66. The beam 70 is located distally from the outlets 24,26 relative to the caps 62,64 when the key 28 is installed.

In order to expose the outlets 24,26, the key handle 66 is preferably gripped and rotated about the center axis 32 or otherwise to thereby cause the caps 62,64 to become disengaged from the nozzles 44,46 exposing the outlets 24,26. The body 11 may then be appropriately positioned to dispense the solutions contained within the chambers through the outlets 24,26.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A vial comprising:

a body having a first end, a second end, and a cavity therebetween, said body elongated along a length;

a baffle internal to the body separating the cavity into a first and a second chamber, a first and second outlet disposed toward the second end of the body on the body, said first and second outlets providing communication from the first and second chambers, respectively, when the outlets are placed in an open configuration;

a key having a first and second cap connected thereto, said first and second caps initially provided in an installed position on the first and second outlets, respectively, thereby placing the vial in a closed configuration, whereby twisting of the key places the vial in an open configuration removing the caps from the outlets;

wherein the outlets are disposed along a plane extending through the length of the body and the baffle intersects the plane intermediate about 15 to about 75 degrees.

2. The vial of claim 1 wherein the body has a central axis relative to a cross section of the body taken at the first end of the body, and the central axis is coplanar with the plane through the length of the body through the outlets.

3. The vial of claim 2 wherein the first and second caps are symmetrically positioned relative to the central axis.

4. The vial of claim 2 wherein the cross section of the body taken at the first end is characterized by substantially parallel walls having a first axis segment intermediate the cross section of the body extending perpendicularly therethrough at the center axis and a second axis segment intermediate the cross section of the body intersecting the first axis perpendicularly at the center axis, said first segment having a length shorter than a length of the second axis.

5. The vial of claim 4 wherein the first and second outlets are symmetrical about the first axis segment.

6. The vial of claim 4 wherein the baffle is angled relative to one of the first and second axes between about thirty and sixty degrees.

7. The vial of claim 6 wherein the baffle terminates closer to the first end of the body than the first and second outlets.

8. The vial of claim 7 wherein a valley is located intermediate the baffle and the second end of the body, said valley external to the body and formed by first and second slopes extending toward the second end of the body toward the outlets as the first and second slopes extend away from each other.

9. The vial of claim 6 wherein the baffle spans the cavity intermediate the substantially parallel walls at the first end of the body.

10. The vial of claim 1 wherein the vial is initially provided with the body having an open first end.

11. The vial of claim 10 wherein the vial is constructed of a heat sealable material and after at least one of the first and second chambers are filled, said first end sealed to provide water tight compartments in the first and second chambers when the key is in the closed position.

12. The vial of claim 1 wherein the key and body are initially integrally molded in the closed configuration.

13. A vial comprising:

a body having a first end, a second end, and a cavity therebetween;

a baffle internal to the body separating the cavity into a first and a second chamber, said first and second chambers not in fluid communication with one another in the cavity when the first end of the body is sealed;

a first and second outlet disposed toward the second end of the body on the body, said first and second outlets providing communication from the first and second chambers, respectively, when the respective outlet is placed in an open configuration; and wherein said baffle terminates intermediate the first and second end of the body, and a valley is located intermediate the baffle and the second end of the body, said valley defined by first and second slopes extending away from each other as they proceed toward the second end of the body, said body having a cross section intermediate the first and second ends of the body with substantially parallel walls having a first axis extending perpendicularly therethrough, and said baffle angled intermediate about thirty to about sixty degrees relative to the first axis.

14. The vial of claim 13 further comprising a key having a first and second cap connected thereto, said first and second caps initially provided in an installed position on the first and second outlets, respectively, thereby placing the vial outlets in a closed configuration.

15. A vial comprising:

a body having a first end, a second end, and a cavity intermediate thereto;

a baffle located in the cavity separating the cavity into a first and a second chamber;

said first and second chambers not in fluid communication with one another in the cavity;

a first and second outlet located toward the second end of the body on the body, said first and second outlets providing communication with the first and second chambers respectively when the respective outlet are placed in an open configuration;

wherein said body has a cross section intermediate the first and second ends characterized by opposing substantially parallel walls which are substantially perpendicular to a first axis segment extending intermediate thereto, and the baffle intersects the first axis intermediate about 15° to about 75°.

16. The vial of claim 15 wherein the baffle intersects the first axis intermediate about 30 to about 60 degrees.

17. The vial of claim 15 wherein the opposing substantially parallel walls are symmetric about a center axis of the cavity at the first end of the body and the baffle is substantially planar.

18. The vial of claim 15 wherein the opposing substantially parallel walls are connected by curved segments to provide the cross section, and the baffle terminates intermediate the first and second ends of the body.

19. The vial of claim 15 further comprising a key having a first and second cap connected thereto, said first and second caps initially provided in an installed configuration on the first and second outlets, respectively, thereby placing the vial outlets in a closed configuration, wherein displacement of the key removes the caps from the outlets thereby placing the vial outlets in an open configuration.

* * * * *